US009868602B2

(12) United States Patent
Kawamura

(10) Patent No.: US 9,868,602 B2
(45) Date of Patent: Jan. 16, 2018

(54) SHEET FEEDER, IMAGE FORMING APPARATUS, AND IMAGE FORMING SYSTEM

(71) Applicant: CANON KABUSHIKI KAISHA, Tokyo (JP)

(72) Inventor: Koji Kawamura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/371,767

(22) Filed: Dec. 7, 2016

(65) Prior Publication Data

US 2017/0166412 A1 Jun. 15, 2017

(30) Foreign Application Priority Data

Dec. 11, 2015 (JP) ..... 2015-242642

(51) Int. Cl.

| | |
|---|---|
| ***B65H 3/06*** | (2006.01) |
| ***B65H 7/02*** | (2006.01) |
| ***B65H 7/18*** | (2006.01) |
| ***B65H 5/06*** | (2006.01) |
| ***G03G 15/00*** | (2006.01) |

(52) U.S. Cl.

CPC ..... *B65H 7/02* (2013.01); *B65H 3/0676* (2013.01); *B65H 5/062* (2013.01); *B65H 7/18* (2013.01); *G03G 15/6511* (2013.01); *B65H 2403/50* (2013.01); *G03G 15/6564* (2013.01); *G03G 2215/00396* (2013.01)

(58) Field of Classification Search

CPC .. B65H 3/0669; B65H 3/0676; B65H 3/5207; B65H 3/5215; B65H 7/18

USPC ..... 271/10.03, 10.11, 110, 121, 125

See application file for complete search history.

(56) References Cited

U.S. PATENT DOCUMENTS

| | | | | |
|---|---|---|---|---|
| 3,961,786 A * | 6/1976 | Yanker | B65H 3/5261 | 271/10.03 |
| 5,927,703 A * | 7/1999 | Endo | B65H 3/06 | 271/10.03 |
| 6,565,077 B2 * | 5/2003 | Kawada | B65H 3/06 | 271/10.03 |

(Continued)

FOREIGN PATENT DOCUMENTS

| | | |
|---|---|---|
| JP | 10-167494 A | 6/1998 |
| JP | 2001-151368 A | 6/2001 |

(Continued)

*Primary Examiner* — David H Bollinger

(74) *Attorney, Agent, or Firm* — Canon U.S.A., Inc. IP Division

(57) ABSTRACT

A sheet feeder includes a first rotary member, a separation member that cooperates with the first rotary member in holding the sheet between the separation member and the first rotary member to define a separation nip, a conveyance unit disposed downstream of the separation nip in a conveyance direction of the sheet, a driving unit, and a control unit. The first rotary member feeds a sheet. The conveyance unit conveys the sheet. The driving unit drives the first rotary member. The control unit controls the driving unit to stop driving the first rotary member when a leading edge of the sheet reaches the conveyance unit, and controls the driving unit to restart driving the first rotary member when a trailing edge portion of the sheet comes out of the separation nip.

19 Claims, 12 Drawing Sheets

(56) References Cited

U.S. PATENT DOCUMENTS

| | | | | |
|---|---|---|---|---|
| 8,382,093 | B2 * | 2/2013 | Dan | B65H 1/14 271/10.03 |
| 8,573,585 | B1 * | 11/2013 | Boucher | B65H 3/0607 271/10.03 |
| 8,590,884 | B2 * | 11/2013 | Maruta | G03G 15/6564 271/10.03 |
| 8,608,155 | B2 * | 12/2013 | Yatsunami | B65H 7/06 271/10.03 |
| 8,827,259 | B2 * | 9/2014 | Fujii | G03G 15/6564 271/10.02 |
| 2001/0022422 | A1 * | 9/2001 | Tamura | B65H 7/18 271/10.03 |

FOREIGN PATENT DOCUMENTS

| | | | |
|---|---|---|---|
| JP | 2004-244161 | A | 9/2004 |
| JP | 2014-149360 | A | 8/2014 |

* cited by examiner

SHEET FEEDER, IMAGE FORMING APPARATUS, AND IMAGE FORMING SYSTEM

BACKGROUND OF THE INVENTION

Field of the Invention

An embodiment relates to a sheet feeder, an image forming apparatus, and an image forming system.

Description of the Related Art

An image forming apparatus, such as a printer, includes a sheet feeder that feeds and conveys a sheet contained in a sheet containing unit to a conveyance roller disposed downstream of the sheet containing unit. In the sheet feeder, a plurality of sheets fed by a pickup roller is separated into a preceding sheet and a succeeding sheet by a feed roller and a separation roller. When the preceding sheet reaches the conveyance roller, the sheet feeder stops the pickup roller and the feed roller and allows the conveyance roller to draw the preceding sheet (refer to Japanese Patent Laid-Open No. 10-167494). This prevents the succeeding sheet from being conveyed downward of a separation nip in a sheet conveyance path.

While the preceding sheet is drawn by the conveyance roller, a backward tension is applied to the preceding sheet. The backward tension is caused by torque (separation resistance) produced by a torque limiter attached to the separation roller. The backward tension is released immediately when a trailing edge of the sheet comes out of the separation nip. Consequently, the sheet may vibrate to cause a sudden noise. Recently, there have been growing expectations for noise reduction in sheet feeders and image forming apparatuses. Demand for reduced sudden noise levels is increasing in the market.

SUMMARY OF THE INVENTION

Embodiments work towards reducing noises associated with sheet feeding.

According to an aspect of the present invention, a sheet feeder includes a first rotary member configured to feed a sheet, a separation member that cooperates with the first rotary member in holding the sheet between the separation member and the first rotary member to define a separation nip, a conveyance unit disposed downstream of the separation nip in a conveyance direction of the sheet, wherein the conveyance unit is configured to convey the sheet, a driving unit configured to drive the first rotary member, and a control unit configured to control the driving unit, wherein the control unit controls the driving unit to stop driving the first rotary member when a leading edge of the sheet reaches the conveyance unit, and controls the driving unit to restart driving the first rotary member when a trailing edge portion of the sheet comes out of the separation nip.

Further features of the present invention will become apparent from the following description of exemplary embodiments with reference to the attached drawings.

DESCRIPTION OF THE EMBODIMENTS

First Embodiment

Configuration of Image Forming Apparatus

Figure 1:
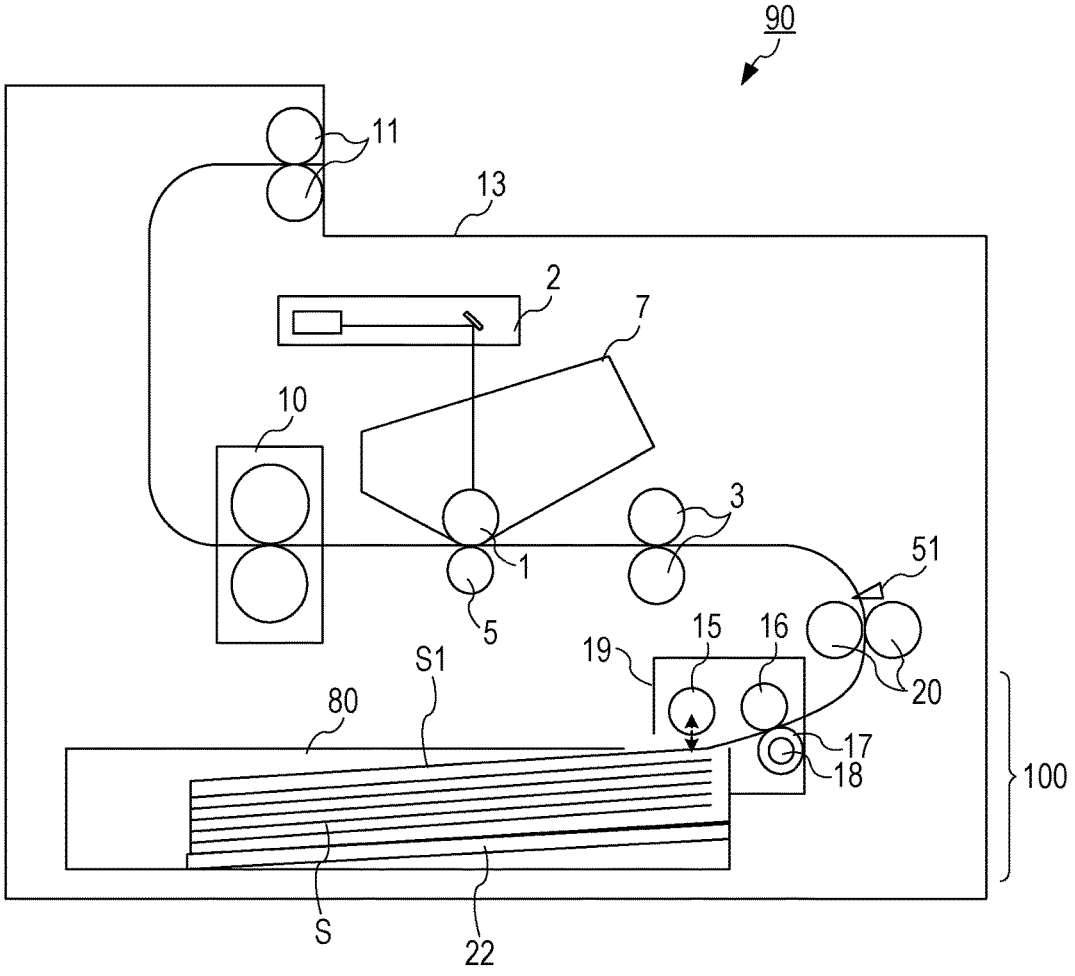
FIG. 1 is a sectional view of an image forming apparatus.

Embodiments of the present invention will be described with reference to the drawings. Components common to the drawings are designated by the same reference numerals. FIG. 1 illustrates an image forming apparatus 90 including a sheet feeder 100. The sheet feeder 100 may be an optional sheet feeder that is detachable from the image forming apparatus 90. In such a case, the image forming apparatus 90 may be an image forming system including the sheet feeder 100 and an image forming apparatus connected to the sheet feeder 100. The image forming apparatus 90 is, for example, a monochrome laser beam printer. The image forming apparatus 90 may be a copier, a multifunction peripheral, or a facsimile machine. An image forming method does not necessarily have to be an electrophotographic printing method. Another method, such as an electrostatic recording method or an inkjet method, may be used.

A process cartridge 7 includes a photosensitive drum 1 functioning as an image bearing member. An exposure unit 2 is disposed in the vicinity of the photosensitive drum 1. The exposure unit 2 applies laser light based on image information to the photosensitive drum 1 to form an electrostatic latent image on the photosensitive drum 1. The process cartridge 7 develops the electrostatic latent image with toner to form a toner image. A transfer roller 5 transfers the toner image on the photosensitive drum 1 to a sheet. A fixing unit 10 fixes the toner image to the sheet. A discharge roller pair 11 discharges the sheet to a discharge unit 13.

The sheet feeder 100 includes a containing unit 80 and a sheet feeding unit 19. In a standby mode, a sheet stacker 22 of the containing unit 80 lifts sheets S to a feed level. In the standby mode, a pickup roller 15 is disposed above the sheets S. The pickup roller 15 is moved downward in response to an input feed signal, so that the pickup roller 15 contacts the uppermost sheet S1 of the sheets S stacked on the sheet stacker 22. The pickup roller 15 picks up the sheet S1 and sends the sheet to a conveyance path. In the conveyance path, a feed roller 16 and a separation roller 17 that function as a separation unit are arranged downstream of the pickup roller 15. The feed roller 16 and the separation roller 17 define a separation nip therebetween. In the separation nip, the preceding sheet S1 is separated from a succeeding sheet taken and moved by the sheet S1 and only the preceding sheet S1 is conveyed downstream in the conveyance path. The feed roller 16 is rotated in a first direction (counterclockwise) to convey the sheet S1 downstream. The separation roller 17 may be rotated in the first direction (counterclockwise) to return the succeeding sheet to the containing unit 80. Thus, the preceding sheet S1 is separated from the succeeding sheet. The separation roller 17 can also be referred to as a retard roller. The separation roller 17 may include a torque limiter 18. A drawing roller pair 20 draws the sheet S1, separated alone, from the separation nip and conveys the sheet further downstream. The drawing roller pair 20 is a kind of conveyance roller. A sensor 51 for detecting the position of a sheet may be disposed downstream of the drawing roller pair 20. The sensor 51 can be disposed upstream of the drawing roller pair 20. A registration roller pair 3 is disposed downstream of the drawing roller pair 20. The registration roller pair 3 sends the sheet S1 to a transfer nip defined between the photosensitive drum 1 and the transfer roller 5. Thus, the toner image is transferred to the sheet S1.

Controller

Figure 2:
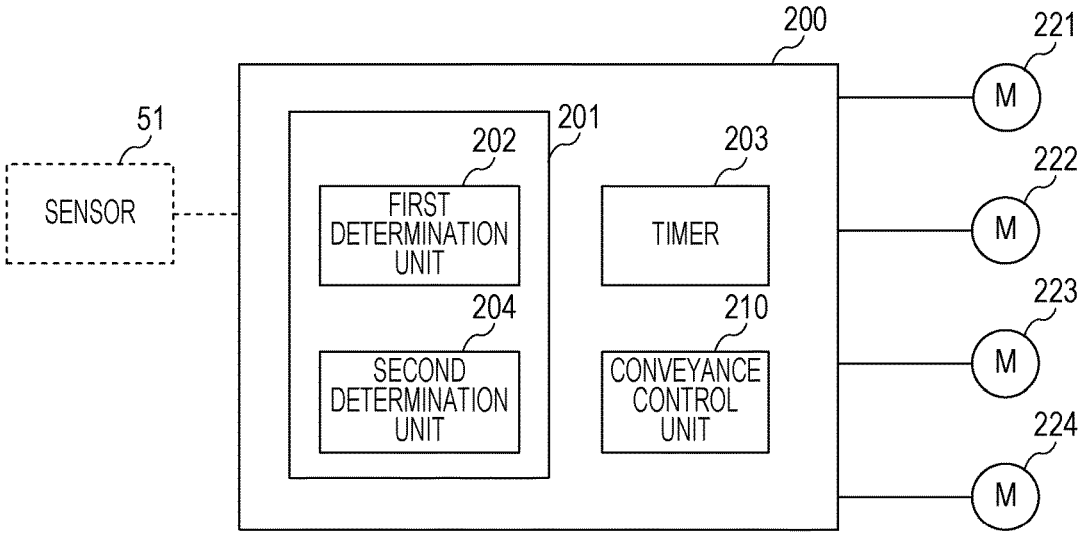
FIG. 2 is a diagram illustrating a controller.

FIG. 2 illustrates functions of a controller 200. Examples of the controller 200 include a central processing unit (CPU) that executes a control program stored in a read-only memory (ROM) to achieve various functions, an application specific integrated circuit (ASIC), and a field programmable gate array (FPGA). The various functions may be achieved by a combination of these examples. The sensor 51 is an example of a detection unit that detects a sheet (for example, the leading edge of a sheet). An estimation unit 201 estimates the position of a sheet based on a detection result of the sensor 51. For example, when the leading edge of a sheet reaches the sensor 51, the sensor 51 outputs a signal indicating that the sheet is passing to the controller 200. When the signal output from the sensor 51 changes from a signal indicating that any sheet is not passing to a signal indicating that a sheet is passing, the estimation unit 201 estimates that the leading edge of a sheet has reached the sensor 51. On the other hand, when the signal output from the sensor 51 changes from a signal indicating that a sheet is passing to a signal indicating that any sheet is not passing, the estimation unit 201 estimates that the trailing edge of the sheet has left the sensor 51. When the estimation unit 201 determines the position of the leading edge of the sheet based on the signal output from the sensor 51, a timer 203 may start to measure time. The estimation unit 201 may estimate the position of a sheet by using a count value of the timer 203. For example, the estimation unit 201 can determine the position of the trailing edge based on a count value of the timer 203. A first determination unit 202 may determine, based on a detection result of the sensor 51, whether the leading edge of the preceding sheet reaches the drawing roller pair 20. A second determination unit 204 may determine, based on a count value of the timer 203, whether a trailing edge portion of the preceding sheet reaches the separation nip. The term "trailing edge portion" as used herein refers to a given area extending from the trailing edge. The term "leading edge portion" as used herein refers to a given area extending from the leading edge. A conveyance control unit 210 controls a first motor 221, a second motor 222, a third motor 223, and a fourth motor 224. The first motor 221 is a drive source that drives and rotates the pickup roller 15. The second motor 222 is a drive source that drives and rotates the feed roller 16. The third motor 223 is a drive source that drives and rotates the drawing roller pair 20. The conveyance control unit 210 may stop the first motor 221 and the second motor 222 when the leading edge of the preceding sheet reaches the drawing roller pair 20, and actuates the second motor 222 when the trailing edge portion of the preceding sheet reaches the separation nip. Such control is useful in reducing the above-described sudden noise. The fourth motor 224 is a drive source that moves the pickup roller 15 upward or downward. The fourth motor 224 may be a drive source, such as a solenoid. Furthermore, the fourth motor 224 may move the containing unit 80 upward or downward instead of the pickup roller 15. If a contacting and releasing mechanism for moving the pickup roller 15 into contact with or away from the sheet S is omitted, the fourth motor 224 can also be omitted. The controller 200 may be disposed in a main body of the image forming apparatus 90 or may be disposed in the sheet feeder 100. Part of the controller 200 may be disposed in the main body of the image forming apparatus 90 and the other parts of the controller may be arranged in the sheet feeder 100. For example, the estimation unit 201 and the conveyance control unit 210 may be arranged in the main body of the image forming apparatus 90 and drive circuits for the motors may be arranged in the sheet feeder 100. For example, a main controller included in the main body of the image forming apparatus 90 may include the estimation unit 201, the conveyance control unit 210, and a communication circuit. A sub-controller included in the sheet feeder 100 may include a communication circuit for communication with the main controller and the drive circuits for the motors. The main controller and the sub-controller communicate with each other via a communication line, for example.

Sheet Feeding and Conveyance Control

Figure 3:
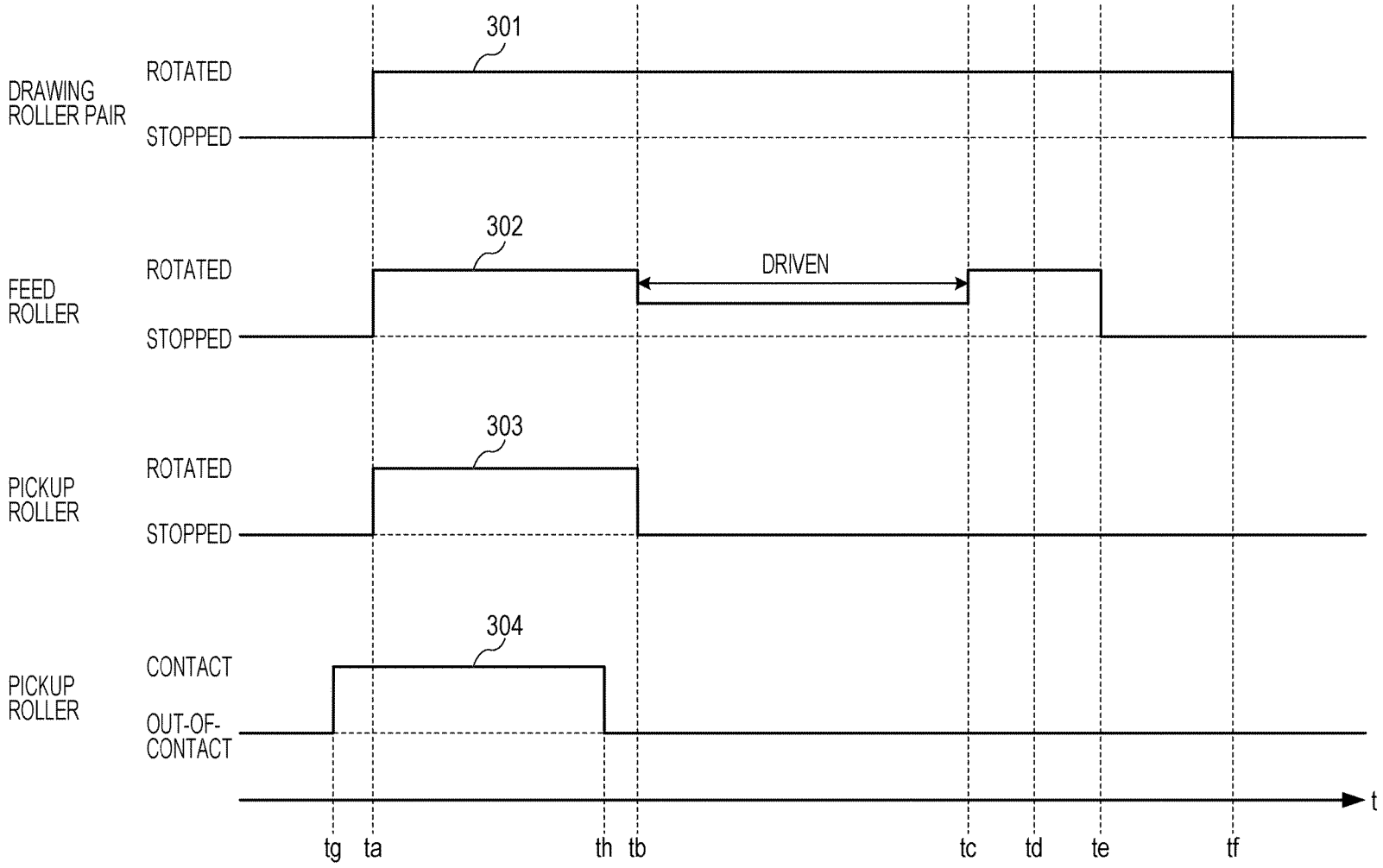
FIG. 3 is a diagram illustrating timing of control by a sheet feeder.
Figure 4:
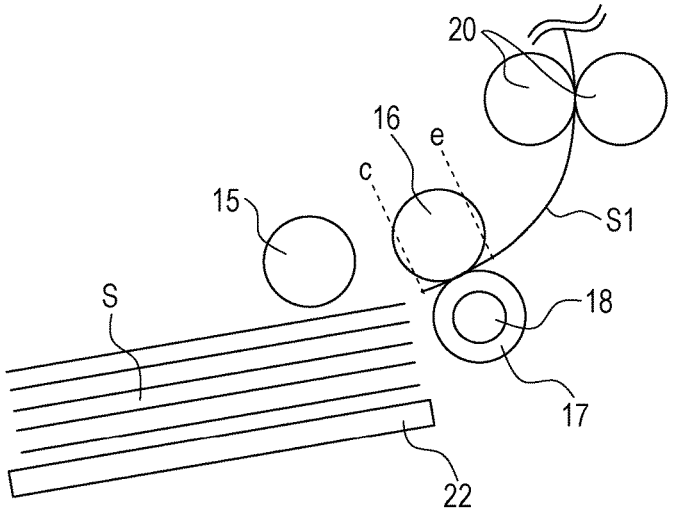
FIG. 4 is a sectional view of the sheet feeder.

Sheet feeding and conveyance control will now be described with reference to FIGS. 3 and 4. FIG. 3 illustrates timing of sheet feeding and conveyance control of the sheet S1. In FIG. 3, reference numeral 301 denotes a rotated or stopped state of the drawing roller pair 20, reference numeral 302 denotes a rotated or stopped state of the feed roller 16, reference numeral 303 denotes a rotated or stopped state of the pickup roller 15, and reference numeral 304 denotes a state of the pickup roller 15 in or out of contact with the sheet S. FIG. 4 illustrates the sheet feeder 100 just before the trailing edge, indicated at c, of the sheet S1 reaches the separation nip. Referring to FIG. 4, the trailing edge portion of the sheet S1 extends from the trailing edge c to a point e. When a feed signal is input at time tg, the conveyance control unit 210 drives the fourth motor 224 to move the pickup roller 15, which is out of contact with or away from the sheet S1, downward such that the pickup roller 15 contacts the sheet S1. At time to that substantially coincides with time tg, the conveyance control unit 210 actuates the first motor 221, the second motor 222, and the third motor 223. Consequently, the pickup roller 15, the feed roller 16, and the drawing roller pair 20 are rotated. The preceding sheet S1 and a succeeding sheet fed to the conveyance path by the pickup roller 15 are separated in the separation nip. The preceding sheet S1 alone reaches the drawing roller pair 20. When the sheet S1 reaches the drawing roller pair 20 at time th, the conveyance control unit 210 drives the fourth motor 224 to move the pickup roller 15 upward such that the pickup roller 15 is moved away from, or released from the sheet S. At time tb, the conveyance control unit 210 stops the first motor 221 and the second motor 222. The conveyance control unit 210 continues to drive the third motor 223, so that the sheet S1 is drawn from the separation nip by the drawing roller pair 20. At this time, the feed roller 16 is rotated (driven) by the preceding sheet S1. Resistance produced by the torque limiter 18 is applied as a backward tension to the preceding sheet S1. In other words, the drawing roller pair 20 overcomes the backward tension to convey the preceding sheet S1. The backward tension applied to the sheet S1 at this time will be referred to as a "first backward tension".

The conveyance control unit 210 again actuates the second motor 222 at time tc just before the trailing edge of the preceding sheet S1 reaches the separation nip as illustrated in FIG. 4. Since the trailing edge portion of the preceding sheet S1 is conveyed by the feed roller 16, the backward tension applied to the preceding sheet S1 decreases. This reduces a sudden noise that may be generated at time td when the trailing edge of the preceding sheet S1 passes through the separation nip. A backward tension applied to the sheet S1 at this time is a second backward tension, which is smaller than the first backward tension.

Figure 5:
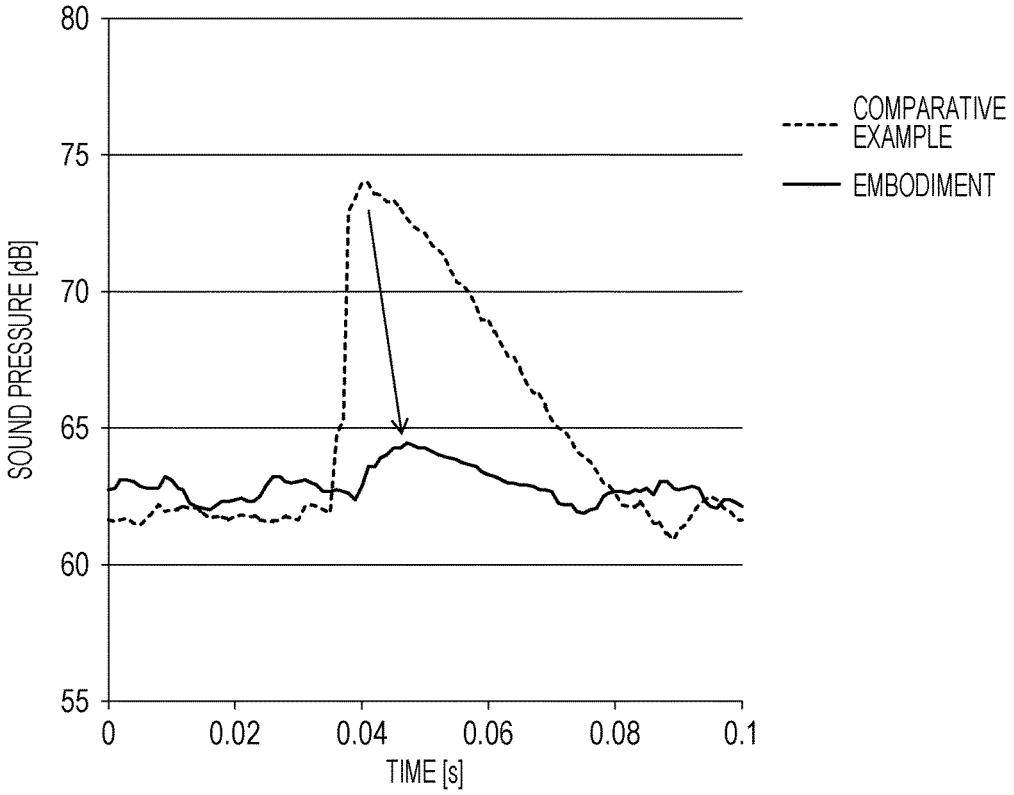
FIG. 5 is a graph illustrating a result in an embodiment.

FIG. 5 illustrates measurements of sudden noises occurred when the preceding sheet S1 came out of the separation nip. In Comparative Example, the second motor 222 was kept stopped during a period from time tc to time te. Since a large backward tension was applied to the sheet S1 in Comparative Example, a loud sudden noise occurred when the sheet came out of the separation nip. According to the present embodiment, in contrast, the magnitude of such a sudden noise is significantly reduced.

The conveyance control unit 210 stops the second motor 222 at time te just after the trailing edge of the preceding sheet S1 passes through the separation nip. The conveyance control unit 210 stops the third motor 223 at time tf when the trailing edge of the preceding sheet S1 passes through the drawing roller pair 20. Consequently, the operation of feeding the preceding sheet S1 is completed. In FIG. 4, the trailing edge of the preceding sheet S1 is located at the middle of the separation nip at time td.

Flowchart

Figure 6:
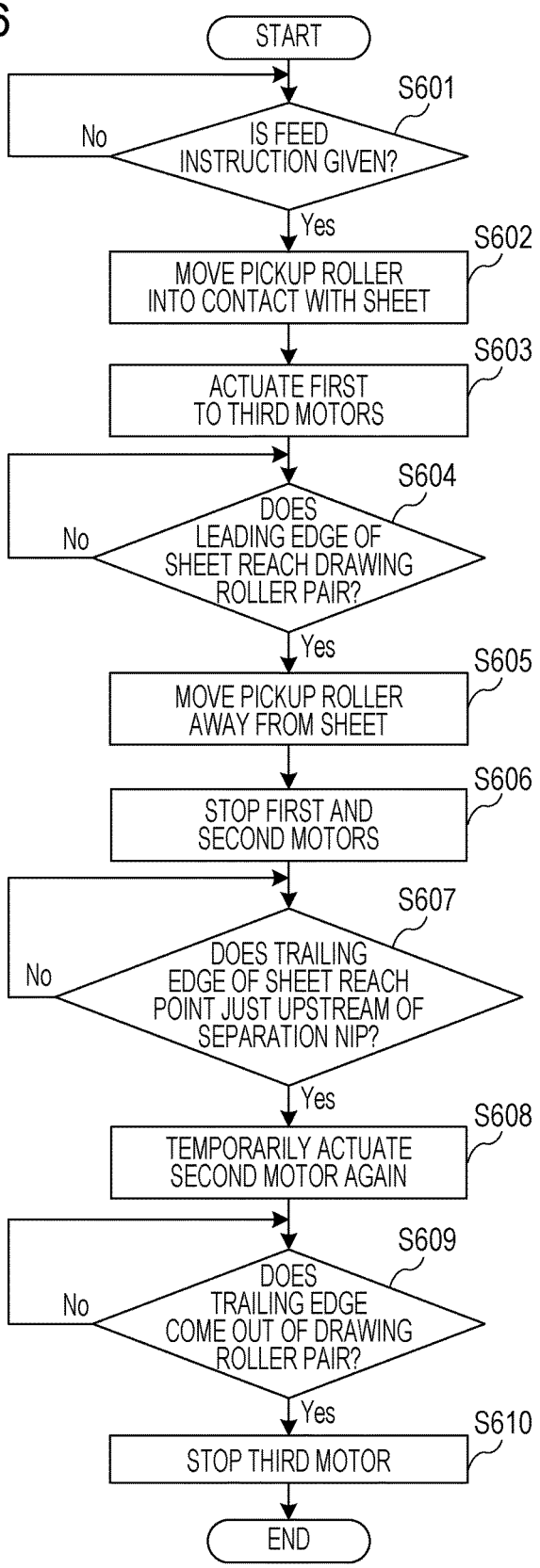
FIG. 6 is a flowchart illustrating a process of sheet conveyance control.

FIG. 6 illustrates a process performed by the controller 200. In the standby mode, the controller 200 allows the pickup roller 15 to be away from the sheet S. In S601, the controller 200 determines whether a feed instruction is given by a control unit connected with the controller 200, such as a printer control unit. The controller 200 proceeds to S602 in response to receiving a feed signal. In S602, the controller 200 allows the pickup roller 15 to be moved into contact with the sheet S. For example, the conveyance control unit 210 actuates the fourth motor 224 to move the pickup roller 15 downward such that the pickup roller 15 contacts the sheet S. In S603, the controller 200 allows the conveyance control unit 210 to actuate the first motor 221, the second motor 222, and the third motor 223. Consequently, the pickup roller 15, the feed roller 16, and the drawing roller pair 20 are rotated. In S604, the controller 200 (first determination unit 202) determines whether the leading edge of the sheet S1 reaches the drawing roller pair 20. In the case where the sensor 51 is disposed downstream of the drawing roller pair 20, when the sensor 51 detects the leading edge, the first determination unit 202 determines that the leading edge reaches the drawing roller pair 20. In the case where the sensor 51 is disposed upstream of the drawing roller pair 20, when a first predetermined time has elapsed after detection of the leading edge by the sensor 51, the first determination unit 202 determines that the leading edge reaches the drawing roller pair 20. The first predetermined time is the time required for movement of the leading edge from the sensor 51 to the drawing roller pair 20. The first predetermined time can be obtained by dividing a conveyance distance from the sensor 51 to the drawing roller pair 20 by a sheet conveying speed. The first predetermined time may be measured in advance by simulation or experiment. When the leading edge reaches the drawing roller pair 20, the controller 200 proceeds to S605. In S605, the controller 200 allows the pickup roller 15 to be moved away from the sheet S. For example, the conveyance control unit 210 actuates the fourth motor 224 to move the pickup roller 15 upward such that the pickup roller 15 is released from the sheet S. In S606, the controller 200 (conveyance control unit 210) stops the first motor 221 and the second motor 222. Consequently, the pickup roller 15 and the feed roller 16 are stopped. Furthermore, a backward tension is applied to the sheet S1. In S607, the controller 200 determines whether the trailing edge of the sheet S1 reaches a point just upstream of the separation nip. The point just upstream of the separation nip is a proper position for actuating again the second motor 222 to reduce the backward tension and thus reduce a sudden noise. In other words, the point just upstream of the separation nip is away from the middle of the separation nip by a distance obtained based on a time required to again actuate the second motor 222 and the sheet conveying speed. The second determination unit 204 starts the timer 203 when the sensor 51 detects the leading edge. When a count value of the timer 203 indicates a second predetermined time, the second determination unit 204 determines that the trailing edge reaches the point just upstream of the separation nip. The second predetermined time is a period between the time when the leading edge reaches the sensor 51 and the time when the trailing edge reaches the point just upstream of the separation nip. The second predetermined time is determined before shipment of the sheet feeder 100 from a factory. The second predetermined time is obtained by the above-described calculation, simulation, or experiment. When the trailing edge reaches the point just upstream of the separation nip, the controller 200 proceeds to S608. In S608, the controller 200 (conveyance control unit 210) temporarily actuates the second motor 222. Consequently, the feed roller 16 is rotated in a direction in which the backward tension is reduced. In S609, the controller 200 determines whether the trailing edge of the sheet S1 comes out of the drawing roller pair 20. In the case where the sensor 51 is disposed downstream of the drawing roller pair 20, when the sensor 51 detects the trailing edge, the controller 200 determines that the trailing edge comes out of the drawing roller pair 20. In the case where the sensor 51 is disposed upstream of the drawing roller pair 20, when a third predetermined time has elapsed after detection of the trailing edge by the sensor 51, the controller 200 determines that the trailing edge comes out of the drawing roller pair 20. When the trailing edge comes out of the drawing roller pair 20, the controller 200 proceeds to S610. In S610, the controller 200 stops the third motor 223. Consequently, the drawing roller pair 20 is also stopped. As described above, the sheet feeder 100 is controlled such that a backward tension is temporarily reduced when the trailing edge portion of the sheet S1 comes out of the separation nip. Thus, a sudden noise can be reduced.

Modifications of Separating Mechanism

Figure 7A:
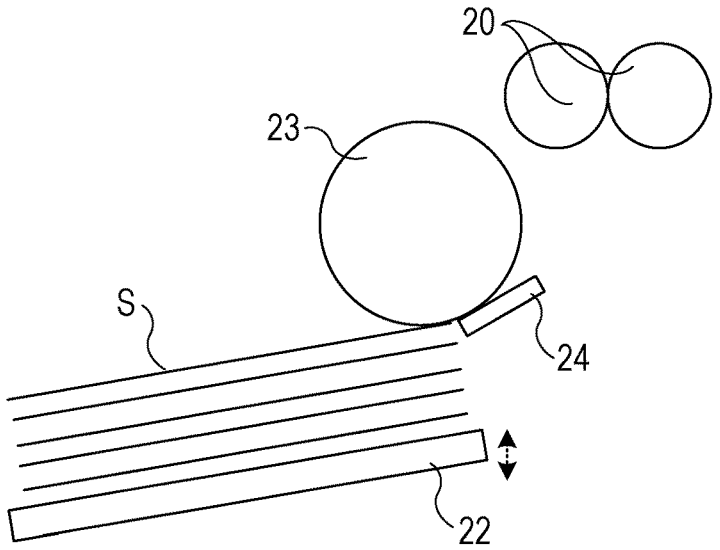
FIGS. 7A and 7B are sectional views of a sheet feeder.
Figure 7B:
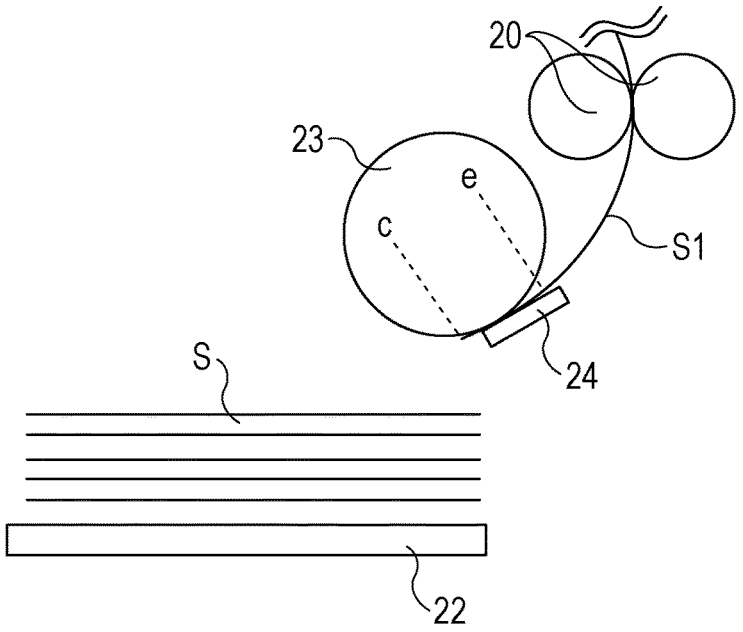

FIGS. 7A and 7B illustrate modifications of the first embodiment. A sheet feeding roller 23 is a rotary member having the functions of the pickup roller 15 and the feed roller 16. Since the pickup roller 15 and the feed roller 16 are integrated into such a single rotary member, the first motor 221 is eliminated and the second motor 222 drives the sheet feeding roller 23. A separating pad 24 is a separation member that separates a preceding sheet from a succeeding sheet. The separating pad 24 and the sheet feeding roller 23 define a separation nip therebetween. The sheet feeding roller 23 is brought into or out of contact with the sheet S by moving the sheet stacker 22 upward or downward. The sheet stacker 22 can be moved upward or downward by the fourth motor 224. Referring to FIG. 7A, the sheet stacker 22 is positioned at an upper level such that the sheet feeding roller 23 is in contact with the sheet S. Referring to FIG. 7B, the sheet stacker 22 is positioned at a lower level such that the sheet feeding roller 23 is away from the sheet S. The rest of the configuration is the same as that described in the first embodiment. An embodiment is applicable to such a configuration in which the pickup roller 15 and the feed roller 16 are integrated into one rotary member. Specifically, since the sheet feeding roller 23 is controlled such that a backward tension is temporarily reduced when the trailing edge portion of the sheet S1 comes out of the separation nip, a sudden noise can be reduced.

Second Embodiment

Omission of Contacting and Releasing Mechanism

In the first embodiment, reducing a sudden noise produced when the trailing edge of a sheet comes out of the separation nip reduces a noise associated with sheet feeding. In a second embodiment, reducing a driving noise associated with contact and release further reduces a noise associated with sheet feeding. The difference between the second embodiment and the first embodiment, that is, a mechanical configuration of the sheet feeder 100 will be mainly described below. In the second embodiment, a description of the same components as those in the first embodiment is omitted.

Figure 8:
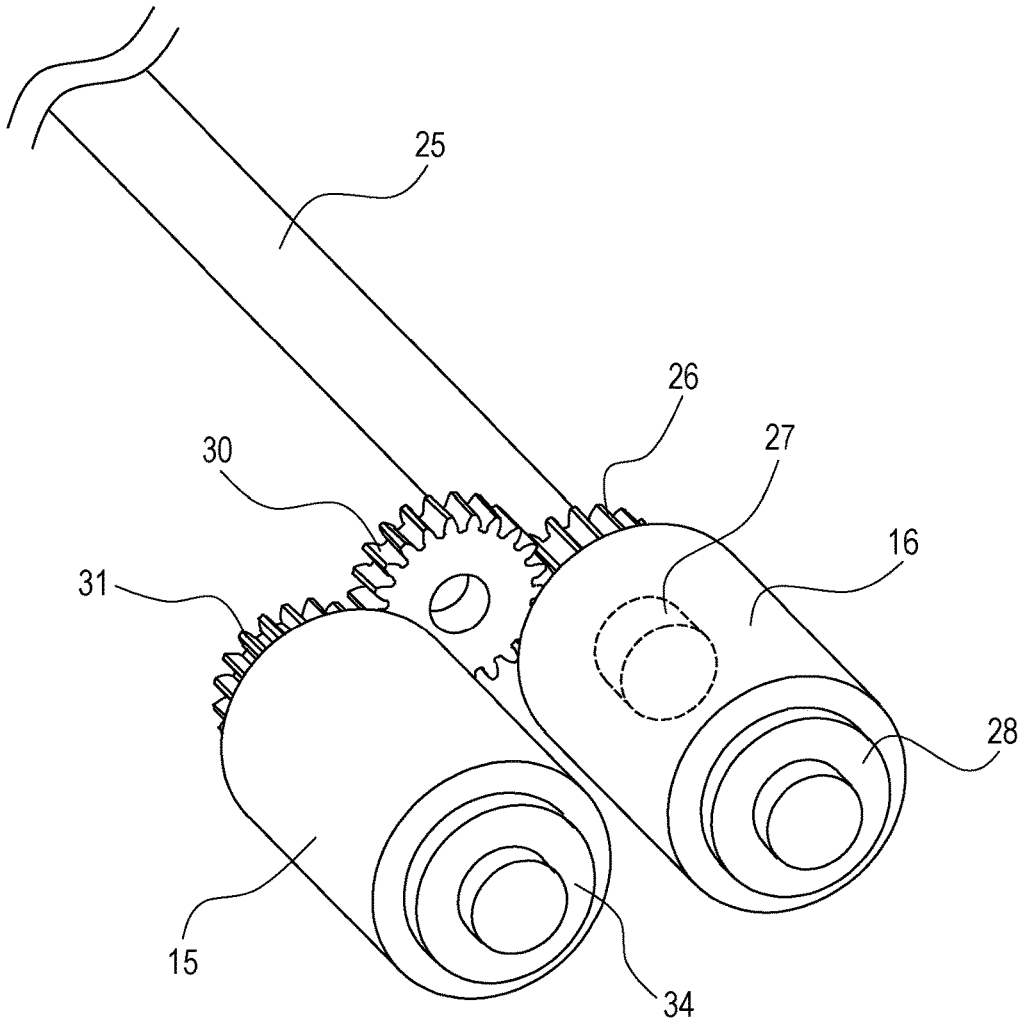
FIG. 8 is a perspective view of a driving mechanism for a pickup roller.

FIG. 8 is a perspective view illustrating the pickup roller 15, the feed roller 16, and components arranged adjacent to these rollers. In the second embodiment, the second motor 222 drives the feed roller 16 and the pickup roller 15. The first motor 221 is accordingly eliminated. A feed shaft 25 transmits a driving force of the second motor 222 to the feed roller 16 and the pickup roller 15. A one-way clutch 27 is a mechanical component that transmits rotation of the feed shaft 25 to the feed roller 16 attached to a feed-roller holder 28. Although the one-way clutch 27 transmits the rotation of the feed shaft 25 to the feed-roller holder 28, this clutch is configured not to transmit rotation of the feed-roller holder 28 to the feed shaft 25. While the feed roller 16 is driven by the sheet S, rotation of the feed roller 16 is not transmitted to the feed shaft 25. A feed gear 26 is rotated in unison with the feed shaft 25. An idler gear 30 engages with the feed gear 26 and a pick gear 31, and transmits a driving force of the feed gear 26 to the pick gear 31. The pickup roller 15 is attached to a pickup-roller holder 34. The pickup-roller holder 34 transmits a driving force of the pick gear 31 to the pickup roller 15. In the pick gear 31 and the pickup-roller holder 34, a slide member, which will be described later, is disposed. The slide member functions as a delay unit that delays the driving force of the pick gear 31 by a predetermined time and transmits the delayed driving force to the pickup-roller holder 34.

Description of Issues

Figure 9A:
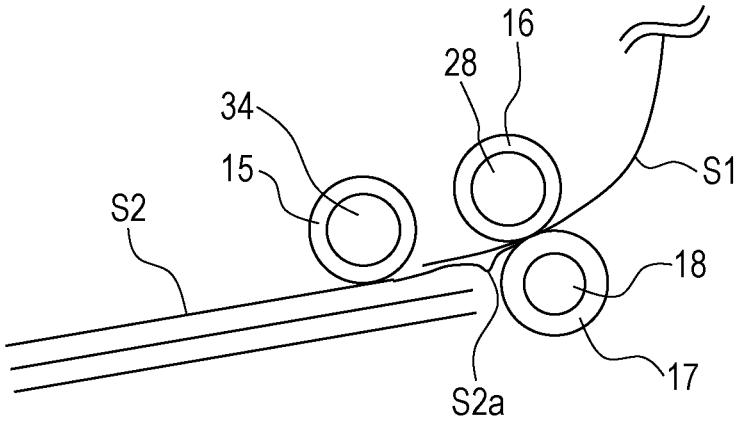
FIGS. 9A and 9B are diagrams explaining issues of a sheet feeder excluding a contacting and releasing mechanism.
Figure 9B:
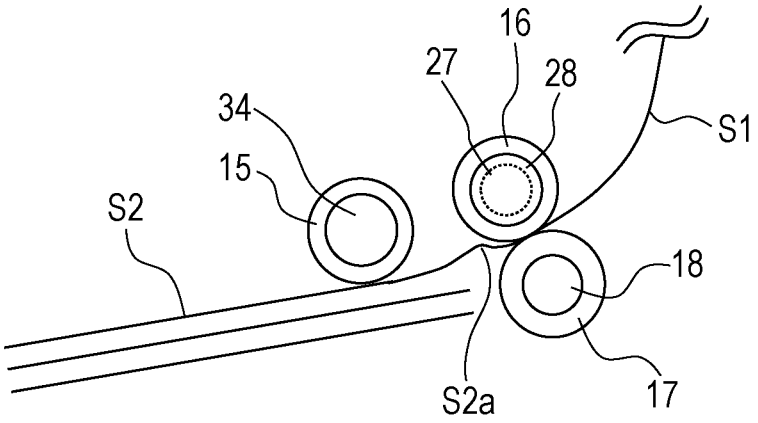

In the second embodiment, the sheet stacker 22 is urged at the upper level by an elastic member, such as a spring, to provide constant contact between the pickup roller 15 and the sheet S. The constant contact between the pickup roller 15 and the sheet S needs the one-way clutch 27 and the slide member. FIGS. 9A and 9B are diagrams explaining the need for the one-way clutch 27 and the slide member.

FIG. 9A illustrates the sheet feeder 100 excluding the one-way clutch 27 and a slide member 32. FIG. 9A illustrates a state just after the trailing edge of the sheet S1 left the pickup roller 15. At this time, the feed roller 16 and the pickup roller 15 are not driven by the motor. The sheet S1 is conveyed downstream while being drawn by the drawing roller pair 20. The feed roller 16 is driven or rotated by the sheet S1. The rotation of the feed roller 16 is transmitted to the pickup roller 15 through the feed-roller holder 28, the feed shaft 25, the feed gear 26, the idler gear 30, and the pick gear 31. When the pickup roller 15 is rotated, a succeeding sheet S2 is fed downstream. When the leading edge of the succeeding sheet S2 reaches the separation nip, the sheet S2 is separated from the sheet S1 and is stopped. As described above, since the sheet S2 is fed by the pickup roller 15, abuts the separation roller 17, and is separated from the sheet S1, a leading edge portion S2*a* of the sheet S2 may bend. The bending of the sheet S2 may cause buckling or jamming of the sheet S2. It is therefore necessary to reduce the bending. For this purpose, the sheet feeder 100 providing constant contact between the pickup roller 15 and the sheet S needs the one-way clutch 27 in order to prevent rotation of the feed roller 16 from being transmitted to the pickup roller 15. The one-way clutch 27 interrupts transmission of the rotation of the feed roller 16, driven by the sheet S1, to the pickup roller 15. Stopping the second motor 222 stops feeding the succeeding sheet S2, thus reducing the bending of the leading edge portion S2*a*.

FIG. 9B illustrates the sheet feeder 100 including the one-way clutch 27 but excluding the slide member. FIG. 9B illustrates a state in which the trailing edge portion of the sheet S1 is located in the separation nip. While the second motor 222 is continuously driven by the controller 200, both the feed roller 16 and the pickup roller 15 are rotated and the succeeding sheet S2 is fed. When the leading edge of the sheet S2 reaches the separation nip, the sheet S2 is separated from the sheet S1 and is stopped. Consequently, the leading edge portion S2*a* of the sheet S2 may bend. The sheet feeder 100 providing constant contact between the pickup roller 15 and the sheet S, therefore, needs a delay mechanism for transmitting the driving force of the second motor 222 such that the driving force is transmitted to the pickup roller 15 after the driving force is transmitted to the feed roller 16.

Description about Operation of Delay Mechanism

FIGS. 10A to 10D illustrate an operation of the delay mechanism for delaying the rotation of the pick gear 31 by a predetermined time and transmitting the delayed rotation to the pickup-roller holder 34. FIGS. 11A and 11B are exploded perspective views of the delay mechanism. Referring to FIGS. 11A and 11B, the pick gear 31 and the slide member 32 are fitted around a shaft 34*b* extending axially through the pickup-roller holder 34. In FIGS. 11A and 11B, teeth of the pick gear 31 are not illustrated.

Figure 10A:
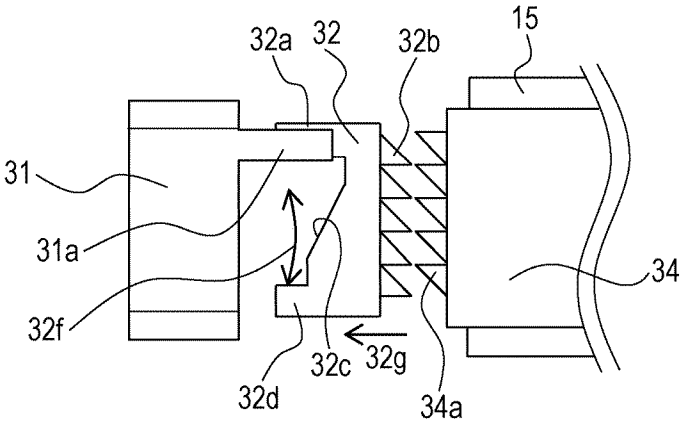
FIGS. 10A to 10D are diagrams explaining an operation of a delay mechanism.
Figure 11A:
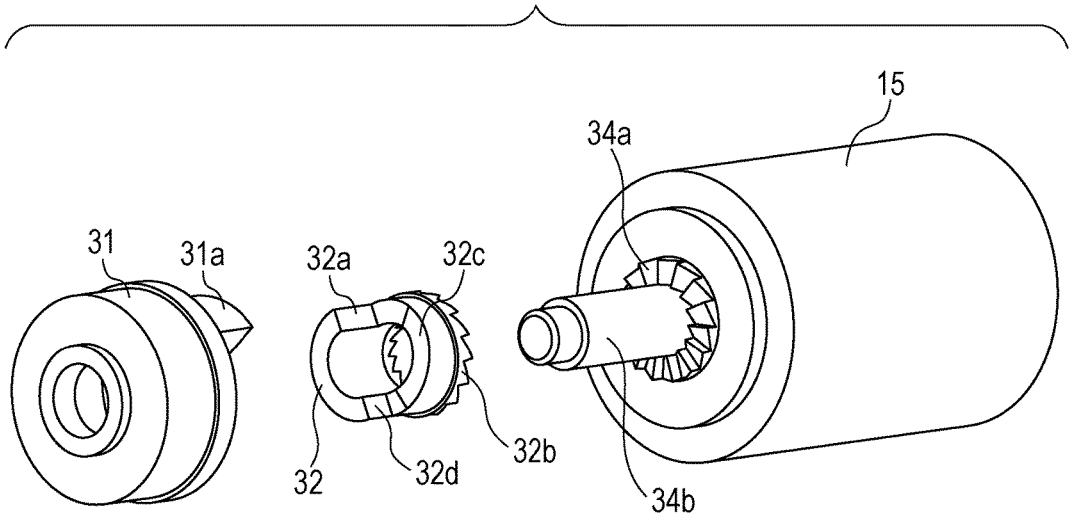
FIGS. 11A and 11B are exploded perspective views of the delay mechanism.
Figure 11B:
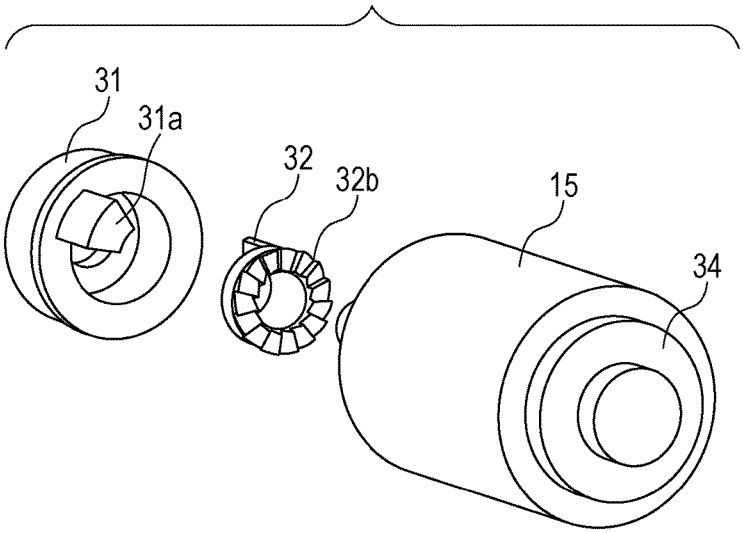

FIG. 10A illustrates a state in which a maximum delay is provided. At this time, a side surface of a pin-shaped rib 31*a*, extending from a side surface of the pick gear 31, abuts against an abutment surface 32*a* of the slide member 32. The rib 31*a* extends parallel to the rotation axis of the pick gear 31 and is radially spaced apart from the rotation axis (center) of the pick gear 31. In other words, rotation of the pick gear 31 allows the tip of the rib 31*a* to trace a circular locus having a smaller radius than the pick gear 31. The slide member 32 has a groove (notch), which receives the rib 31*a*, on a first side surface of the slide member 32. FIG. 10A demonstrates that the groove has a gradually varying depth. In other words, the groove has a bottom surface, serving as a slope 32*c*. This groove is a kind of notch because it is formed by cutting part of a cylinder. The slide member 32 includes a ratchet 32*b* on a second side surface thereof. The pickup-roller holder 34 includes a ratchet 34*a* on a first side surface facing the second side surface of the slide member 32 such that the ratchet 34*a* can engage with the ratchet 32*b*. In FIG. 10A, the ratchet 32*b* of the slide member 32 is apart from the ratchet 34*a* of the pickup-roller holder 34.

Figure 10B:
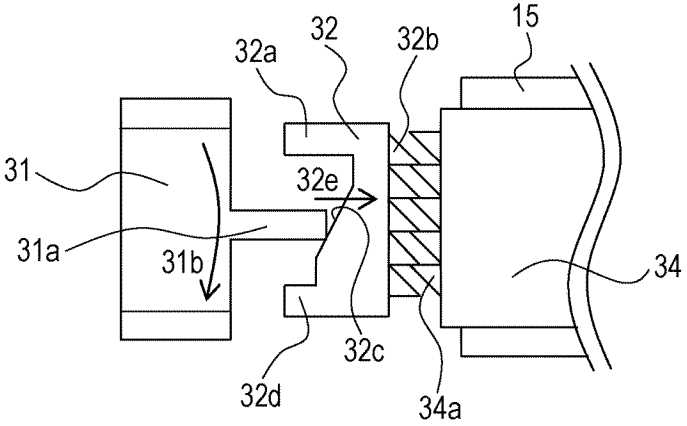

As illustrated in FIG. 10B, as the pick gear 31 is rotated in a direction indicated by an arrow 31*b*, the tip of the rib 31*a* presses the slope 32*c* of the slide member 32, so that the slide member 32 slides in a direction indicated by an arrow 32*e*. Consequently, the ratchet 32*b* starts to engage with the ratchet 34*a*. Since the slide member 32 is not rotated at this time, the pickup-roller holder 34 is not rotated.

Figure 10C:
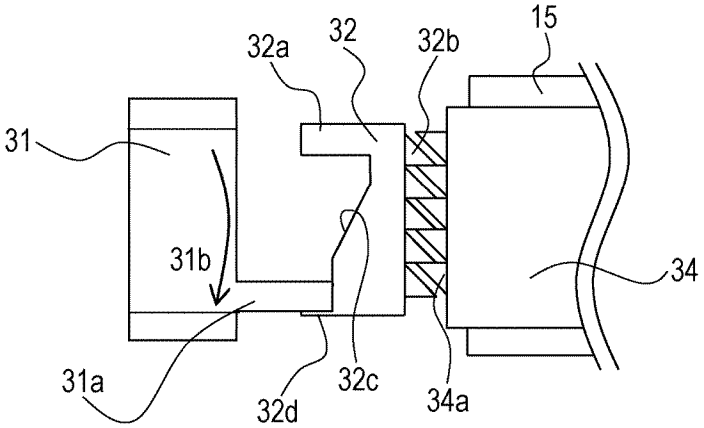

Further rotation of the pick gear 31 causes another side surface of the rib 31*a* to abut against an abutment surface 32*d* of the slide member 32 as illustrated in FIG. 10C. Thus, the rotation of the pick gear 31 is transmitted to the slide member 32 and the pickup-roller holder 34. Such a delay mechanism delays the transmission of rotation of the pick gear 31 to the pickup-roller holder 34 by a period of time during which the rib 31*a* is moved by a distance 32*f*.

Figure 10D:
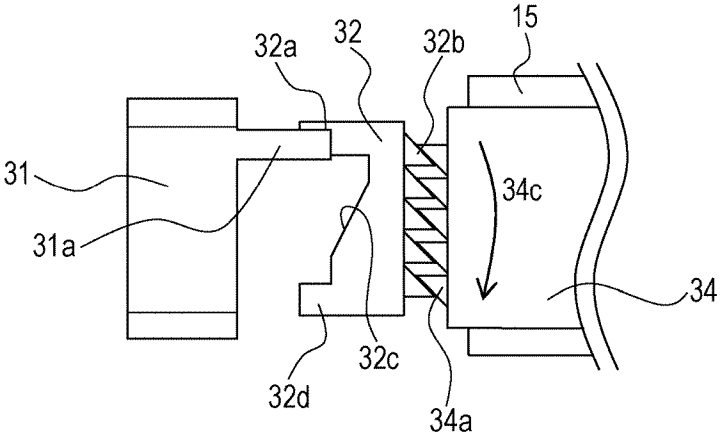

How a delay corresponding to the distance 32*f* is provided will now be described. While the pick gear 31 is stopped, when the pickup-roller holder 34 is rotated in a direction indicated by an arrow 34*c*, sloping faces of the ratchet 34*a* press sloping faces of the ratchet 32*b* of the slide member 32, thus rotating the slide member 32 in the direction indicated by the arrow 34*c*. Consequently, the abutment surface 32*a* abuts against the rib 31*a* as illustrated in FIG. 10D. Although the pick gear 31 may seem to rotate in a reverse direction in FIG. 10D, it is merely an illustration for explanation of the positional relationship between the components or parts. Actually, the pickup-roller holder 34 and the slide member 32 are rotated.

The abutment surface 32*a* abuts against the rib 31*a*, thus inhibiting the slide member 32 from rotating. Furthermore, the sloping faces of the ratchet 34*a* and those of the ratchet 32*b* press together, so that the slide member 32 slides in a direction indicated by an arrow 32*g*, thus providing the state illustrated in FIG. 10A. As described above, when the pickup roller 15 is driven or rotated by the sheet S while the pick gear 31 is not driven, the delay mechanism provides a delay corresponding to the distance 32*f*.

Sheet Feeding Operation

Figure 12:
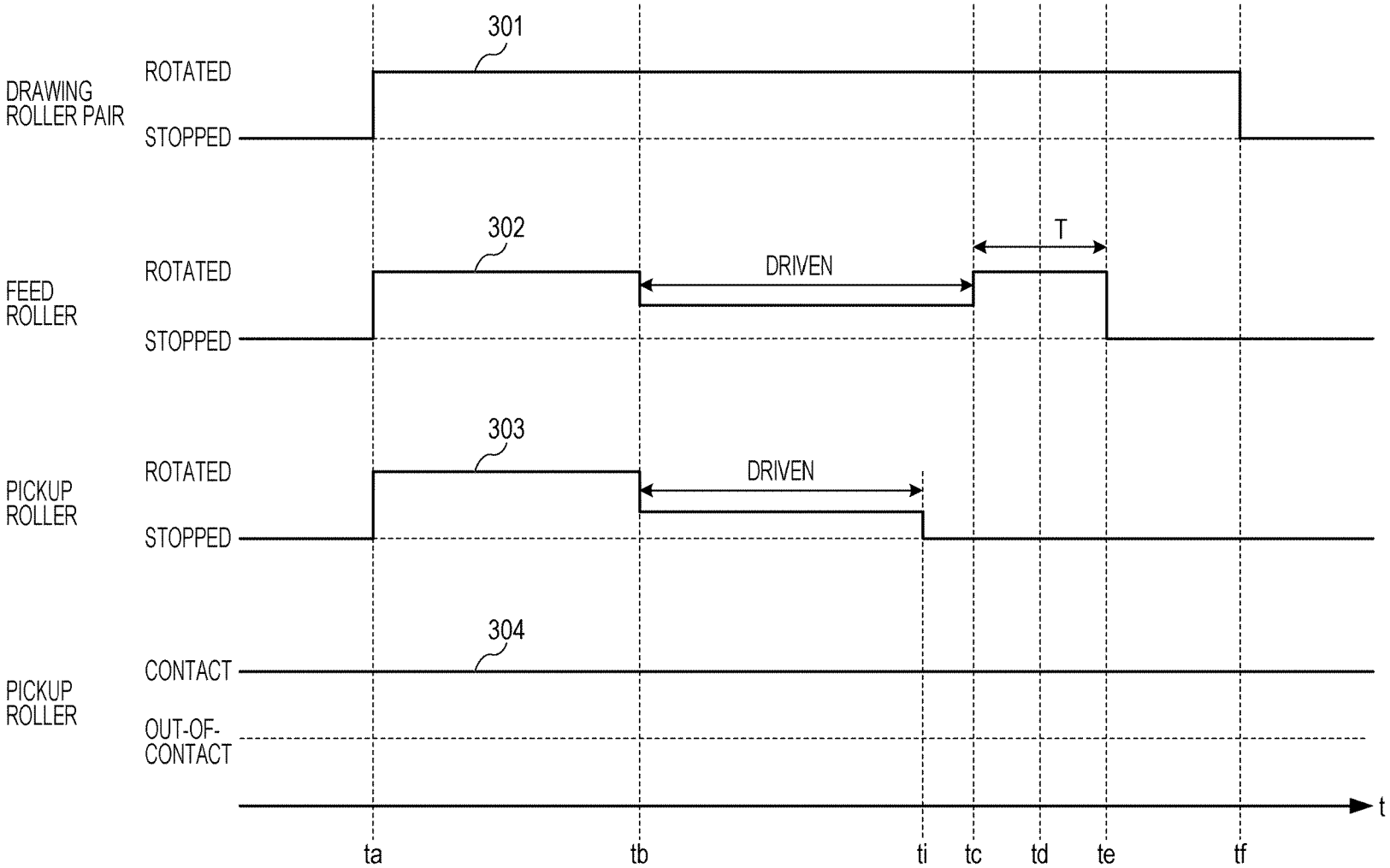
FIG. 12 is a diagram illustrating timing of control by a sheet feeder.
Figure 13:
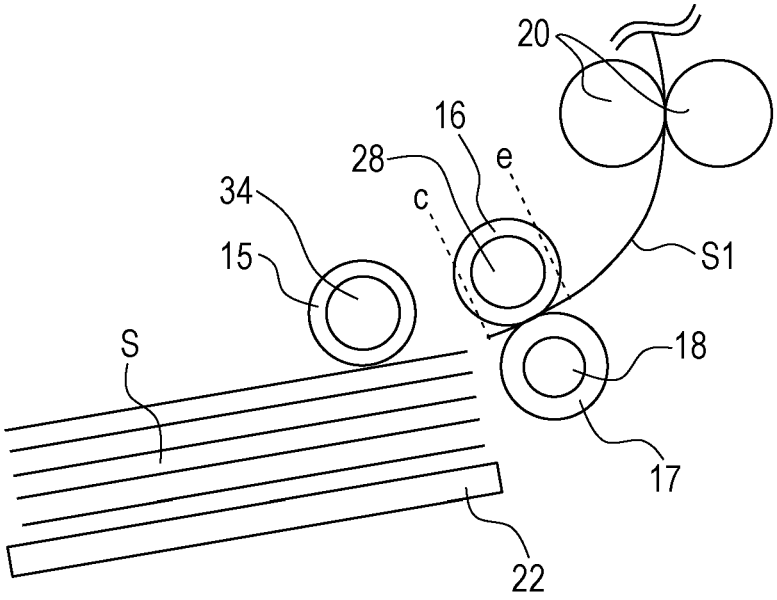
FIG. 13 is a sectional view of the sheet feeder.

FIG. 12 illustrates states of the rollers and contact and out-of-contact states of the pickup roller 15 in sheet feeding. In FIG. 12, portions common to FIG. 3 are designated by the same reference numerals. FIG. 13 illustrates the sheet feeder 100 in a state just before the trailing edge of the sheet S1 reaches the separation nip. As illustrated in FIG. 12, the pickup roller 15 is maintained in contact with the sheet S. Since the operation (hereinafter, referred to as "contacting and releasing operation") of moving the pickup roller into and out of contact with the sheet is not performed in the second embodiment, an operation noise is less than that in the first embodiment in which the releasing operation is performed each time one sheet is fed. In addition, it is unnecessary to provide a transition time for transition from the out-of-contact state to the contact state. This allows a reduction in sheet interval for feeding a plurality of sheets. The term "sheet interval" as used herein refers to the distance between the trailing edge of the preceding sheet S1 and the leading edge of the succeeding sheet S2 or a time corresponding to this distance. Thus, the productivity (or the number of sheets subjected to image formation per unit time) of the image forming apparatus 90 is increased.

When a feed signal is input at time ta, the controller 200 actuates the second motor 222 to rotate the feed roller 16 and the pickup roller 15. In addition, the controller 200 actuates the third motor 223 to rotate the drawing roller pair 20. The sheets S1 and S2 fed by the pickup roller 15 are separated in the separation nip, the sheet S1 alone is conveyed downstream, and the sheet S1 reaches the drawing roller pair 20. When the sheet S1 reaches the drawing roller pair 20 at time tb, the controller 200 stops the second motor 222. The controller 200 continues to drive the third motor 223 so that the sheet S1 is drawn from the separation nip by the drawing roller pair 20. After that, the pickup roller 15 and the feed roller 16 are driven or rotated by the sheet S1, the delay mechanism changes from the state of FIG. 10C to the state of FIG. 10D and further to the state of FIG. 10A. Consequently, the delay mechanism can provide a delay corresponding to the distance 32*f*. Furthermore, the resistance of the torque limiter 18 is applied as a backward tension to the sheet S1. In other words, the drawing roller pair 20 overcomes the backward tension to convey the sheet S1. When the trailing edge of the sheet S1 leaves the pickup roller 15 at time ti, the pickup roller 15 is not driven or rotated by the sheet S1, so that the pickup roller 15 is stopped. The controller 200 continues conveying the sheet S1. The controller 200 again drives the second motor 222 at time tc just before the trailing edge of the sheet S1 reaches the separation nip as illustrated in FIG. 13. The second motor 222 is temporarily driven for a period of time T from time tc to time te. Consequently, the feed roller 16 is rotated to convey the trailing edge portion of the sheet S, thus reducing the backward tension applied to the sheet S1. This reduces a sudden noise that may be generated when the trailing edge of the sheet S1 passes through the separation nip.

At this time, the pick gear 31 is rotated, so that the delay mechanism changes from the state of FIG. 10A to the state of FIG. 10C. Consequently, the delay corresponding to the distance 32*f* provided by the delay mechanism is used up. The controller 200 stops the second motor 222 at time to just after the trailing edge of the sheet S1 passes through the separation nip. The distance 32*f* provided by the delay mechanism is set slightly longer than a distance by which the sheet S is conveyed for the period of time T during which the feed roller 16 is again driven. This prevents the pickup roller 15 from being rotated while the feed roller 16 is again driven. Thus, the sheet S is not fed. The controller 200 stops the third motor 223 at time tf at which the trailing edge of the sheet S1 passes through the drawing roller pair 20. Consequently, feeding of the sheet S1 is completed.

According to the second embodiment, the configuration in which the pickup roller 15 is maintained in contact with the sheet S enables elimination of the contacting and releasing operation and thus achieves a further reduction in operation noise of the sheet feeder 100. In the second embodiment, a reduction in sudden noise can be achieved in a manner similar to the first embodiment. This results in a reduction in operation noise of the sheet feeder 100. The elimination of the contacting and releasing operation reduces waiting time associated with the contacting and releasing operation, thus increasing the productivity. In addition, the delay mechanism reduces a likelihood that the sheet S may bend in the vicinity of the separation nip, thus eliminating or reducing buckling or jamming of the leading edge portion of the sheet S.

Summarization

As described above, the feed roller 16, the separation roller 17, the sheet feeding roller 23, and the separating pad 24 serve as a separation unit that separates a preceding sheet from a succeeding sheet. The drawing roller pair 20 is disposed downstream of the separation unit in the sheet conveyance direction and functions as a conveyance unit that conveys a sheet. The controller 200 functions as a reduction unit that temporarily reduces a backward tension when the trailing edge portion of the preceding sheet comes out of the separation unit. The backward tension is a force that is produced by the separation unit while the preceding sheet is conveyed by the conveyance unit and the separation unit and that acts in a direction opposite to the conveyance direction. Since the backward tension is temporarily reduced when the trailing edge portion of the preceding sheet comes out of the separation nip, a sudden noise is reduced. In other words, a noise associated with sheet feeding is reduced.

As described with reference to, for example, FIG. 4, the separation unit includes a first rotary member, such as the feed roller 16 or the sheet feeding roller 23, a separation member, such as the separation roller 17 or the separating pad 24, and a driving unit, such as the second motor 222. The separation member and the first rotary member define the separation nip for holding a sheet therebetween. The second motor 222 drives the feed roller 16 or the sheet feeding roller 23. In the first embodiment, the reduction unit includes a control unit, such as the controller 200 controlling the second motor 222. When the leading edge of the preceding sheet reaches the drawing roller pair 20, the controller 200 stops the second motor 222 to stop driving the first rotary member, thus applying the first backward tension to the preceding sheet. When the trailing edge portion of the preceding sheet comes out of the separation nip, the controller 200 actuates the second motor 222 to restart driving the first rotary member, thus applying the second backward tension smaller than the first backward tension to the preceding sheet. This efficiently reduces a sudden noise generated when the trailing edge portion of the preceding sheet comes out of the separation nip.

As described above, the separation member may be a second rotary member, such as the separation roller 17 disposed to cooperate with the feed roller 16 in holding a sheet between the separation roller 17 and the feed roller 16. The separation roller 17 may include the torque limiter 18, serving as a resistance member that applies rotational resistance to the separation roller 17. Such a configuration enables application of a substantially constant backward tension to a sheet passing through the separation nip. In addition, this configuration enables efficient separation of a preceding sheet and a succeeding sheet.

As described with reference to FIGS. 7A and 7B, the separation member may be a friction member, such as the separating pad 24 urged to the sheet feeding roller 23. As described with reference to FIG. 4, for example, the pickup roller 15 is an example of a pickup unit that is separate from the separation member and is configured to pick up a sheet contained in the containing unit 80 and feed the sheet to the separation member. As described with reference to FIGS. 7A and 7B, the sheet feeding roller 23, serving as the first rotary member, may pick up a sheet contained in the containing unit 80 and then cooperate with the separating pad 24 to separate a preceding sheet from a succeeding sheet.

The containing unit 80 and the pickup roller 15 or the sheet feeding roller 23 are configured such that the roller is brought into or in contact with the uppermost sheet S1 of the sheets contained in the containing unit 80. Such contact is achieved by moving the containing unit 80 upward or downward or moving the pickup roller 15 or the sheet feeding roller 23 upward or downward. As described with reference to, for example, FIGS. 9A and 9B, the sheet stacker 22 may be urged by the elastic member such that the pickup roller 15 or the sheet feeding roller 23 is maintained in contact with the sheet S.

As described with reference to, for example, FIG. 3, the containing unit 80 and the pickup roller 15 or the sheet feeding roller 23 are configured such that the roller is brought out of contact with and away from the uppermost sheet of the sheets contained in the containing unit 80. The roller is brought out of contact with the uppermost sheet at the time when the leading edge of the preceding sheet S1 comes out of the separation nip.

As described with reference to, for example, FIG. 1, the sensor 51 is an example of a detection unit that is disposed upstream or downstream of the drawing roller pair 20 and that detects the leading edge of a preceding sheet. The first determination unit 202 determines, based on a detection result of the sensor 51, whether the leading edge of the preceding sheet reaches the drawing roller pair 20. The second determination unit 204 may determine, based on a time elapsed from the time when the sensor 51 detects the leading edge of the preceding sheet, whether the trailing edge portion of the preceding sheet reaches the separation nip. The controller 200 may stop the second motor 222 when the leading edge of the preceding sheet reaches the drawing roller pair 20 and may actuate the second motor 222 when the trailing edge portion of the preceding sheet reaches the separation nip. Electrically controlling the second motor 222 in that manner can reduce a sudden noise.

As described with reference to, for example, FIGS. 8 and 10A, the driving unit may include the feed gear 26, the idler gear 30, and the pick gear 31. The feed gear 26 is an example of a first transmission unit that transmits a driving force to the feed roller 16. The idler gear 30 and the pick gear 31 are examples of a second transmission unit that transmits the driving force to the pickup roller 15. The second transmission unit may include the delay mechanism for delaying timing of transmitting the driving force to the pickup roller 15 such that the driving force is transmitted to the pickup roller 15 after the driving force is transmitted to the feed gear 26.

As described with reference to, for example, FIG. 10A, the delay mechanism may include a first gear, such as the pick gear 31, a reciprocating member, such as the slide member 32, and a transmitting member, such as the pickup-roller holder 34. The pick gear 31 includes a first rib, such as the rib 31*a*. As described with reference to, for example, FIGS. 10A to 10D, the slide member 32 has the groove that receives the rib 31*a* such that the rib 31*a* reciprocates between a first side wall (abutment surface 32*a*) and a second side wall (abutment surface 32*d*). The slide member 32 further includes the ratchet 32*b* functioning as a first engagement member. The slide member 32 reciprocates in a direction parallel to the rotation axis. The pickup-roller holder 34 includes the ratchet 34*a* that serves as a second engagement member and that periodically engages with the ratchet 32*b* of the slide member 32. Engagement between the ratchet 32*b* of the slide member 32 and the ratchet 34*a* transmits the driving force to the pickup roller 15. The groove of the slide member 32 includes a first portion having a first depth and a second portion having a second depth greater than the first depth. As illustrated in FIG. 10C, the rib 31*a*, serving as the first rib, located in the first portion causes the slide member 32 to move closer to the pickup-roller holder 34 such that the ratchet 32*b* of the slide member 32 engages with the ratchet 34*a* of the pickup-roller holder 34. As illustrated in FIG. 10A, the rib 31*a* located in the second portion causes the slide member 32 to move away from the pickup-roller holder 34 such that the ratchet 32*b* disengages from the ratchet 34*a*. This delays the transmission of the driving force. The use of such a delay mechanism eliminates the need for the contacting and releasing operation for the pickup roller 15. This eliminates a driving noise associated with the contacting and releasing operation. In addition, there is no need for a driving source for the contacting and releasing operation, leading to reduced manufacturing cost. Furthermore, there is no need for waiting time associated with the contacting and releasing operation, leading to increased productivity. The delay mechanism reduces a likelihood that the sheet S may bend in the vicinity of the separation nip, thus eliminating or reducing buckling or jamming of the leading edge portion of the sheet S.

As described with reference to, for example, FIG. 1, the sheet stacker 22 is an example of a stacking unit on which the sheets S are stacked. The pickup roller 15 and the sheet feeding roller 23 are examples of a pickup roller that feeds the sheet S on the stacking unit while being in contact with the sheet. The feed roller 16 is an example of a feed roller that conveys the sheet, fed by the pickup roller 15, downstream. The separation roller 17 and the separating pad 24 are examples of the separation member that is urged to the feed roller 16 to define the separation nip, in which one sheet is separated from the sheets S, between the separation member and the feed roller 16. The drawing roller pair 20 is an example of a conveyance roller that conveys the sheet, separated by the separation member, downstream. A driving force is transmitted to each of the pickup roller 15 and the feed roller 16, the leading edge of the sheet S1 reaches the drawing roller pair 20, and after that, the sheet feeder 100 stops the transmission of the driving force to the feed roller 16. The sheet feeder 100 again transmits the driving force to the feed roller 16 before the trailing edge of the sheet S1 reaches the separation nip. Furthermore, the sheet feeder 100 stops transmitting the driving force to the feed roller 16 after the trailing edge of the sheet S1 passes through the separation nip. As described above, the conveyance control is performed such that a backward tension applied to the sheet S1 is reduced when the trailing edge portion of the sheet S1 comes out of the separation nip, thus reducing a sudden noise.

The above-described sheet feeder 100 is included in an image reader or an image forming apparatus. As illustrated in FIG. 1, the image forming apparatus 90 includes the sheet feeder 100 and an image forming unit (including the process cartridge 7, the exposure unit 2, and the fixing unit 10) for forming an image fed by the sheet feeder. The image forming apparatus 90 that achieves a reduction in driving noise is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-242642, filed Dec. 11, 2015, which is hereby incorporated by reference herein in its entirety.

What is claimed is:

1. A sheet feeder comprising:

a pickup member configured to pick up a sheet stacked on a tray;

a feeding member configured to feed the sheet picked up by the pickup member;

a separation member configured to form a separation nip with the feeding member and configured to separate sheets one by one at the separation nip;

a conveyance unit disposed downstream of the separation nip in a conveyance direction of the sheet and configured to convey the sheet;

a driving unit configured to drive the feeding member; and a control unit configured to control the driving unit, wherein the control unit controls the driving unit to stop driving the feeding member after a leading edge of a first sheet reaches the conveyance unit, and controls the driving unit to restart driving the feeding member while a trailing edge of the first sheet comes out of the separation nip, and wherein the pickup member does not pick up a second sheet succeeding the first sheet before the trailing edge of the first sheet comes out of the separation nip.

2. The sheet feeder according to claim 1, wherein the separation member is a rotary member disposed to cooperate with the feeding member in holding the sheet between the feeding member and the rotary member, and wherein the rotary member includes a resistance member configured to apply rotational resistance to the rotary member.

3. The sheet feeder according to claim 1, wherein the separation member is a friction member urged against the feeding member.

4. The sheet feeder according to claim 1, further comprising:

a detection unit disposed upstream or downstream of the conveyance unit in the conveyance direction of the sheet, wherein the detection unit is configured to detect the leading edge of the first sheet;

a first determination unit configured to determine, based on a detection result of the detection unit, whether the leading edge of the first sheet reaches the conveyance unit; and a second determination unit configured to determine, based on a time elapsed after the detection unit detects the leading edge of the first sheet, whether the trailing edge of the first sheet reaches the separation nip.

5. The sheet feeder according to claim 1, further comprising a third driving unit configured to move the pickup member between a first position and a second position, wherein, in a state that the pickup member is at the first position, the pickup member contacts with an uppermost sheet of the sheets stacked on the tray, and in a state that the pickup member is at the second position, the pickup member does not contact with the uppermost sheet, and wherein the third driving unit moves the pickup member from the first position to the second position after the leading edge of the first sheet reaches the conveyance unit, and does not move the pickup member from the second position to the first position at least until the trailing edge of the first sheet reaches the separation nip.

6. The sheet feeder according to claim 1, further comprising a fourth driving unit configured to move the tray between a first position and a second position, wherein, in a state that the tray is at the first position, the pickup member contacts with an uppermost sheet of the sheets stacked on the tray, and in a state that the tray is at the second position, the pickup member does not contact with the uppermost sheet, and wherein the fourth driving unit moves the tray from the first position to the second position after the leading edge of the first sheet reaches the conveyance unit, and does not move the tray from the second position to the first position at least until the trailing edge of the first sheet reaches the separation nip.

7. The sheet feeder according to claim 1, wherein the driving unit includes a first transmission unit configured to transmit a driving force to the feeding member, and a second transmission unit configured to transmit the driving force to the pickup member, and wherein the second transmission unit includes a delay unit configured to delay timing of transmitting the driving force to the pickup member such that the driving force is transmitted to the pickup member after the driving force is transmitted to the first transmission unit.

8. The sheet feeder according to claim 7, wherein the delay unit includes a first gear including a first rib, a reciprocating member having a groove and including a first engagement member, wherein the groove is defined between a first side wall and a second side wall of the reciprocating member, wherein the groove receives the first rib such that the first rib reciprocates between the first side wall and the second side wall, and wherein the reciprocating member reciprocates in a direction parallel to a rotation axis of the reciprocating member, and a transmitting member including a second engagement member configured to periodically engage with the first engagement member of the reciprocating member, wherein the transmitting member is configured to transmit the driving force to the pickup unit, wherein the groove includes a first portion having a first depth and a second portion having a second depth greater than the first depth, wherein the first rib located in the first portion causes the reciprocating member to move closer to the transmitting member such that the first engagement member of the reciprocating member engages with the second engagement member of the transmitting member, and wherein the first rib located in the second portion causes the reciprocating member to move away from the transmitting member such that the first engagement member of the reciprocating member disengages from the second engagement member of the transmitting member.

9. The sheet feeder according to claim 1, wherein the driving unit includes a feeding motor configured to drive the feeding member and a one-way clutch disposed in the feeding member, and wherein the control unit stops the feeding motor after the leading edge of the first sheet reaches the conveyance unit, and actuates the feeding motor while the trailing edge of the first sheet reaches the separation nip.

10. The sheet feeder according to claim 1, further comprising a second driving unit configured to drive the pickup member, wherein the control unit controls the second driving unit to stop driving the pickup member after the leading edge of the first sheet reaches the conveyance unit, and controls the driving unit not to restart driving the pickup member at least until the trailing edge of the first sheet comes out of the separation nip.

11. The sheet feeder according to claim 10, wherein the second driving unit includes a pickup motor configured to drive the pickup member and a one-way clutch disposed in the pickup member, and wherein the control unit stops the pickup motor after the leading edge of the first sheet reaches the conveyance unit, and does not actuate the feeding motor at least until the trailing edge of the first sheet reaches the separation nip.

12. The sheet feeder according to claim 1, wherein the pickup member is a pickup roller, the feeding member is a feeding roller, and the separation member is a separation roller.

13. A sheet feeder comprising:

a rotary member configured to pick up a sheet stacked on a tray;

a separation member configured to form a separation nip with the rotary member and configured to separate sheets one by one at the separation nip;

a conveyance unit disposed downstream of the separation nip in a conveyance direction of the sheet and configured to convey the sheet;

a driving unit configured to drive the rotary member; and a control unit configured to control the driving unit, wherein the control unit controls the driving unit to stop driving the rotary member after a leading edge of a first sheet reaches the conveyance unit, and controls the driving unit to restart driving the rotary member while a trailing edge of the first sheet comes out of the separation nip, and wherein the rotary member does not pick up a second sheet succeeding the first sheet before the trailing edge of the first sheet comes out of the separation nip.

14. The sheet feeder according to claim 13, wherein the separation member is a second rotary member disposed to cooperate with the rotary member in holding the sheet between the rotary member and the second rotary member, and wherein the second rotary member includes a resistance member configured to apply rotational resistance to the second rotary member.

15. The sheet feeder according to claim 13, wherein the separation member is a friction member urged against the rotary member.

16. The sheet feeder according to claim 13, further comprising:

a detection unit disposed upstream or downstream of the conveyance unit in the conveyance direction of the sheet, wherein the detection unit is configured to detect the leading edge of the first sheet;

a first determination unit configured to determine, based on a detection result of the detection unit, whether the leading edge of the first sheet reaches the conveyance unit; and a second determination unit configured to determine, based on a time elapsed after the detection unit detects the leading edge of the first sheet, whether the trailing edge of the first sheet reaches the separation nip.

17. The sheet feeder according to claim 13, wherein the driving unit includes a motor configured to drive the rotary member and a one-way clutch disposed in the rotary member, and wherein the control unit stops the motor after the leading edge of the first sheet reaches the conveyance unit, and actuates the motor while the trailing edge of the first sheet reaches the separation nip.

18. The sheet feeder according to claim 13, further comprising:

a second driving unit configured to move the tray between a first position and a second position, wherein, in a state that the tray is at the first position, the rotary member contacts with an uppermost sheet of the sheets stacked on the tray, and in a state that the tray is at the second position, the rotary member does not contact with the uppermost sheet, and wherein the second driving unit moves the tray from the first position to the second position after the leading edge of the first sheet reaches the conveyance unit, and does not move the tray from the second position to the first position at least until the trailing edge of the first sheet reaches the separation nip.

19. The sheet feeder according to claim 13, wherein the rotary member is a roller, and the separation member is a separation pad.

* * * * *